US008532560B2

(12) United States Patent
Mizuno et al.

(10) Patent No.: US 8,532,560 B2
(45) Date of Patent: Sep. 10, 2013

(54) RECORDING SHEET DE-CURLING DEVICE AND IMAGE FORMING APPARATUS USING THE SAME

(75) Inventors: Kyoichi Mizuno, Tama (JP); Kunihiro Kawachi, Kokubunji (JP); Masahiro Matsuo, Kokubunji (JP)

(73) Assignee: Konica Minolta Business Technologies, Inc. (JP)

( * ) Notice: Subject to any disclaimer, the term of this patent is extended or adjusted under 35 U.S.C. 154(b) by 411 days.

(21) Appl. No.: 12/711,339

(22) Filed: Feb. 24, 2010

(65) Prior Publication Data

US 2010/0221052 A1 Sep. 2, 2010

(30) Foreign Application Priority Data

Feb. 27, 2009 (JP) ..... 2009-045472

(51) Int. Cl.
*G03G 15/00* (2006.01)
*B65H 23/34* (2006.01)
*B65H 27/00* (2006.01)

(52) U.S. Cl.
USPC ..... 399/406; 271/188

(58) Field of Classification Search
USPC ..... 399/406; 271/188
See application file for complete search history.

(56) References Cited

U.S. PATENT DOCUMENTS 4,554,714 A * 11/1985 Cho ..... 26/75
4,796,680 A * 1/1989 Koba ..... 144/2.1
5,455,992 A * 10/1995 Kurschatke et al. ..... 26/99
6,860,958 B2 * 3/2005 Swafford et al. ..... 156/251
2008/0247796 A1 * 10/2008 Johnston et al. ..... 399/406

FOREIGN PATENT DOCUMENTS

JP 58167346 A * 10/1983
JP 01011282 A * 1/1989
JP 5-341600 A 12/1993
JP 06170406 A * 6/1994
JP 07033302 A * 2/1995
JP 2001139198 A * 5/2001
JP 2002060101 A * 2/2002
JP 2002-241021 A 8/2002
JP 2006306512 A * 11/2006
SU 1399171 A * 5/1988

* cited by examiner

*Primary Examiner* — Daniel J Colilla
*Assistant Examiner* — Nguyen Q Ha
(74) *Attorney, Agent, or Firm* — Cantor Colburn LLP

(57) ABSTRACT

A sheet de-curling device: including a first de-curling roller, structured of a round axial shaft and a long bar-shaped member, wherein the long bar-shaped member is spiraled on the round axial shaft clockwise from a predetermined portion of a center of the round axial shaft toward a left end of the round axial shaft, and counterclockwise from the predetermined portion of the center of the round axial shaft toward a right end of the round axial shaft with the same spiraling pitch; a second de-curling roller, structured of a round axial shaft and a long bar-shaped member, wherein the long bar-shaped member is spiraled on the round axial shaft in opposite spiraling directions against the first de-curling roller; and a driving mechanism which rotates the paired first and second de-curling rollers.

8 Claims, 10 Drawing Sheets

POSITIVE CURL

NEGATIVE CURL

RECORDING SHEET DE-CURLING DEVICE AND IMAGE FORMING APPARATUS USING THE SAME

CROSS REFERENCE TO RELATED APPLICATION

This application is based on Japanese Patent Application No. 2009-045,472 filed on Feb. 27, 2009, with the Japanese Patent Office, the entire content of which is hereby incorporated by reference.

TECHNICAL FIELD

The present invention relates to a de-curling device which is configured to flatten a recording sheet, carrying images formed by image forming apparatuses, such as a copy machine, facsimile device, or a printing machine, and further relates to an image forming apparatus employing the same de-curling device.

BACKGROUND ART

In recent years, various technologies have been employed in order to flatten any curled recording sheets, which technologies are shown below.

(1) As general technologies, a de-curling device, including a paired-roller set formed of a soft roller and a hard roller, is well known, in which a curled recording sheet is conveyed through the soft roller and the hard roller so that the curled recording sheet is flattened. However, a curled recording sheet shown in FIG. 8*a*, which is curled perpendicular to the sheet conveyance direction, (hereinafter referred to as an "orthogonal curl") can be effectively flattened, but a curled recording sheet shown in FIG. 9*a*, which is curled parallel to the sheet conveyance direction (hereinafter referred to as a "parallel curl"), cannot be flattened, and a curled recording sheet shown in FIG. 10*a*, which is obliquely curled, cannot be flattened (hereinafter referred to as an "oblique curl"). Further, in order to flatten various recording sheets, which are curled in the opposite direction as shown in FIGS. 8*b*, 9*b*, and 10*b*, a switching operation to flatten said opposite curled sheet is not prepared in said de-curling device.

(2) Still further, Unexamined Japanese Patent Application Publication Number 2002-241,021 discloses a de-curler, in which a spiral roller and a normal roller are aligned in parallel to press to each other, so that a recording sheet sandwiched between them is flattened. In this de-curling device, spiral structures are symmetrically formed from the center to each end of the spiral roller to flatten the curled recording sheet.

However, the effect of the above technologies are adversely limited, depending on curling directions (such as a positive curl, and a negative curl), curling formations (being the orthogonal curl, the parallel curl, and the oblique curl), and curling amounts. That is, though the curl shown in FIG. 8*a* is effectively flattened, it is very difficult to flatten the various curls shown in FIGS. 8*b*, 9*a*, 9*b*, 10*a*, and 10*b*.

(3) Still further, Unexamined Japanese Patent Application Publication Number 5-341,600 discloses a de-curling device in which a nip section is formed of a belt and a nipping roller, and a curled recording sheet is conveyed through the nip section so that the curled recording sheet is flattened. However, the effect of the above technology is adversely limited, being the same way as the case of item (2).

SUMMARY OF THE INVENTION

An object of the present invention is to flatten the sheets curled in almost all directions, in an image forming apparatus, while being not limited to: the curling direction (being the convex curl or the concave curl); the curling formations (being the parallel curling, perpendicular curing and the oblique curling to the sheet conveyance direction); and curling amounts (being a major curl or a minor curl), in which the problems occurred in above described conventional technologies are effectively overcome, and to offer a de-curling device, wherein the de-curled sheets, which have been flattened by the de-curling device, are not curled again, and the de-curled sheets are stacked evenly on a tray, being convenient for the operator to handle the stacked sheets, and in particular to offer an image forming apparatus, employing the same de-curling device.

The above object is solved by the technical structure detailed below.

1. A sheet de-curling device, including (A), (B) and (C):

(A) a first de-curling roller, structured of a round axial shaft and a long bar-shaped member, wherein the long bar-shaped member is spiraled on the round axial shaft clockwise from a predetermined portion of a center of the round axial shaft toward a left end of the round axial shaft, and counterclockwise from the predetermined portion of the center of the round axial shaft toward a right end of the round axial shaft with the same spiraling pitch; and (B) a second de-curling roller, having the same size as the first de-curling roller, to be paired with the first de-curling roller, structured of a round axial shaft and a long bar-shaped member, wherein the long bar-shaped member is spiraled on the round axial shaft counterclockwise from a predetermined portion of a center of the round axial shaft toward a left end of the round axial shaft, and clockwise from the predetermined portion of the center of the round axial shaft toward a right end of the round axial shaft, with the same spiraling pitch as the pitch of the long bar-shaped member of the first de-curling roller; and (C) a driving mechanism which is configured to rotate the paired first and second de-curling rollers in such a way that, when a sheet is introduced to be nipped between the paired first and second de-curling rollers, and when the paired first and second de-curling rollers are rotated, plural contacting points, on which the sheet comes into contact with the long bar-shaped members of the first and second de-curling rollers, are configured to shift in a direction from a center to both edges of the sheet.

2. An image forming apparatus, including the above described de-curling device.

BRIEF DESCRIPTION OF THE DRAWINGS

Embodiment will now be described, by way of example only, with reference to the accompanying drawings which are meant to be exemplary, not limiting, and wherein like elements are numbered alike in the several figures, in which:

FIG. 5*b* shows a negative curl, that is, a sheet is convex when viewed from above, and its generating line is perpendicular to the sheet feeding direction;

DETAILED DESCRIPTION OF THE PREFERRED EMBODIMENTS

Figure 1:
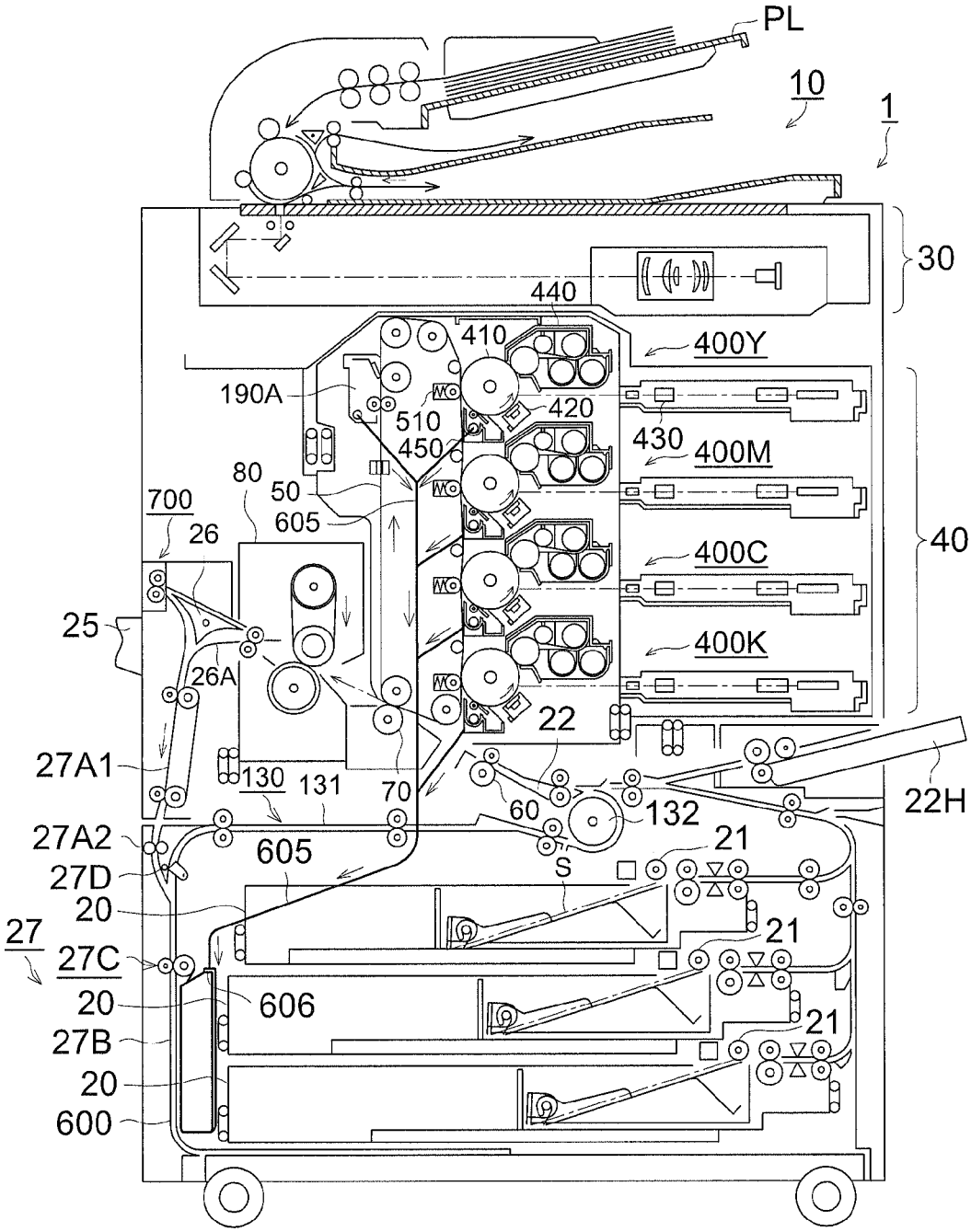
FIG. 1 is a cross sectional view of an image forming apparatus, including a de-curling device, mounted near a sheet ejection tray at a downstream side of an image fixing device.

The image forming apparatus, incorporating the de-curling device of the present invention, will now be detailed, while referring to FIG. 1.

FIG. 1 is a central cross sectional view to show the interior structures of the image forming apparatus, incorporating the de-curling device.

Image forming apparatus 1 is a tandem-type color image forming apparatus, featuring intermediate transfer belt 50.

Image forming apparatus 1 incorporates plural sheet accommodating sections 20. Image forming section 40 and intermediate transfer belt 50 are provided above sheet accommodating sections 20, and image reading section 30 is mounted on an upper area of image forming apparatus 1.

An original document is placed on document supplying plate PL of double surfaces document feeding device 10, and is conveyed to image reading section 30 by various rollers.

Plural sheet accommodating sections can be pulled out toward the front side (which is the depth direction of FIG. 1). Plural sheets, including whites sheets, are accommodated based on their sizes within plural sheet accommodating sections 20. Plural sheets, accommodated in each sheet accommodating section 20, are picked up one by one by sheet supplying roller 21. Further, special sheets, such as coated sheets, or OHP sheets, are set on inserting section 22H.

Image forming section 40 includes image forming engines 400Y, 400M, 400C and 400K, which form toner images of Y, M, C and K, respectively. Image forming engines 400Y, 400M, 400C and 400K are mounted vertically in this order, and each has the same structure.

In order to detail the image forming engine, image forming engine 400Y will be used as an example. Image forming engine includes photoconductive body 410, which rotates counterclockwise, charging section 420, exposure section 430, development section 440, and cleaning section 450. Cleaning section 450 is positioned to include an area to face a lowermost part of photoconductive body 410.

Endless intermediate transfer belt 50 is positioned at the center of image forming apparatus 1, and has predetermined volume resistivity. Between primary transfer roller 510 (being a transfer section) and photoconductive body 410, intermediate transfer belt 50 is sandwiched.

Color image forming operation in image forming apparatus 1 will now be detailed.

Photoconductive body 410 is driven by a drive motor (which is not illustrated), and charged to be negative polarity by charging section 420 (−800V for example). Next, exposure section 430 writes image information on photoconductive body 410 so that electrostatic latent images are formed. After said electrostatic latent images pass through developing section 440, toner particles, having been charged to the negative polarity, adhere to the electrostatic latent images, due to negative polarity development bias in the developing section 440, whereby toner images are formed on photoconductive body 410. The formed toner images are transferred onto intermediate transfer belt 50, which is pressure-contacted with photoconductive body 410. After the transformation of the images, residual toner particles, remaining on photoconductive body 410, are cleaned by cleaning section 450.

The color toner images, which are formed by image forming engines 400Y, 400M, 400C and 400K, are superposed on intermediate transfer belt 50 by primary transfer roller 510 to be transferred, so that a full color image is formed on intermediate transfer belt 50. The recording sheet, supplied one by one from one of sheet accommodating sections 20, is conveyed to paired registration rollers 60, serving as a registration conveyance section, through conveyance path 22. After that, when the recording sheet impinges paired registration rollers 60, the recording sheet temporarily stops, whereby the position of the recording sheet is corrected. When the superposed color toner images on intermediate transfer belt 50 come to a position to be transferred, the recording sheet is conveyed by paired registration rollers 60.

After that, recording sheet is guided by a guide plate, and conveyed to a nipping portion to transfer the image, wherein the nipping portion is formed of intermediate transfer belt 50 and secondary transfer roller 70. At said nipping portion, the recording sheet is pushed toward intermediate transfer belt 50. Since the bias voltage (+500V for example), which exhibits an opposite polarity against the toner particles, is applied onto transfer section 70, the toner image on intermediate transfer belt 50 is transferred to the recording sheet by the electrostatic forces. The recording sheet charges are then neutralized by a separation section (which is not illustrated), including a neutralization pointer, and the recording sheet is separated from intermediate transfer belt 50, to be conveyed to image fixing section 80, including a roller set of heating roller and a pressure applying roller, or including a heating belt and a pressure applying roller. Subsequently, the toner image is permanently fixed to the recording sheet, that is, the recording sheet, carrying the formed image, is flattened by de-curling device 700, and ejected onto tray 25.

The above description concerns a case in which the image is formed on a single surface of the recording sheet. For the case of image formations on both sides, switching member 26 opens sheet guide section 26A, so that the recording sheet is conveyed in a direction shown by an arrow, illustrated by a dashed line.

Further, the recording sheet is conveyed to path 27B by conveyance mechanism 27A1 and 27A2, and the recording sheet is switched to go back by roller set 27C of sheet conveyance device 27. After that, the recording sheet is directed to another path by branching section 27D, that is, a trailing edge of the recording sheet is turned to a leading edge, and the recording sheet is then conveyed to double-surface sheet supplying unit 130.

Subsequently, the recording sheet is conveyed through conveyance guide 131 provided on double surface sheet supplying unit 130, whereby the recording sheet is driven by roller 132 and again guided by conveyance path 22.

After that, the recording sheet is conveyed toward secondary transfer roller 70, and a toner image is transferred on a second surface. The toner image transferred on the reverse surface is then permanently fixed by image fixing device 80. The recording sheet is conveyed to pass through de-curling device 700 to flatten any curling, and ejected onto tray 25.

De-curling device 700 in the above explanation is provided just before tray 25, or it can be provided between image fixing device 80 and switching member 26.

Still further, after the superposed color images are transferred onto the recording sheet by secondary transfer roller 70, the recording sheet is separated from intermediate transfer belt 50, and said belt 50 is cleaned by cleaning section 190A to remove the residual toner particles.

Image forming apparatus 1 of the present embodiment forms the full-color image on the recording sheet by an electro-photographic method. However, the image forming apparatus relating to the present invention is not limited to the present embodiment, that is, the image forming apparatus can be used as an image forming apparatus to form monochromatic images.

In the processes of the image formation, after the residual toner particles on each photoconductive body 410 and intermediate transfer belt 50 are removed by each cleaning section 450 and cleaning section 190A, respectively, the removed toner particles are conveyed through pipe 605, having a spiral member therein, and further conveyed to toner box 600.

Figure 2:
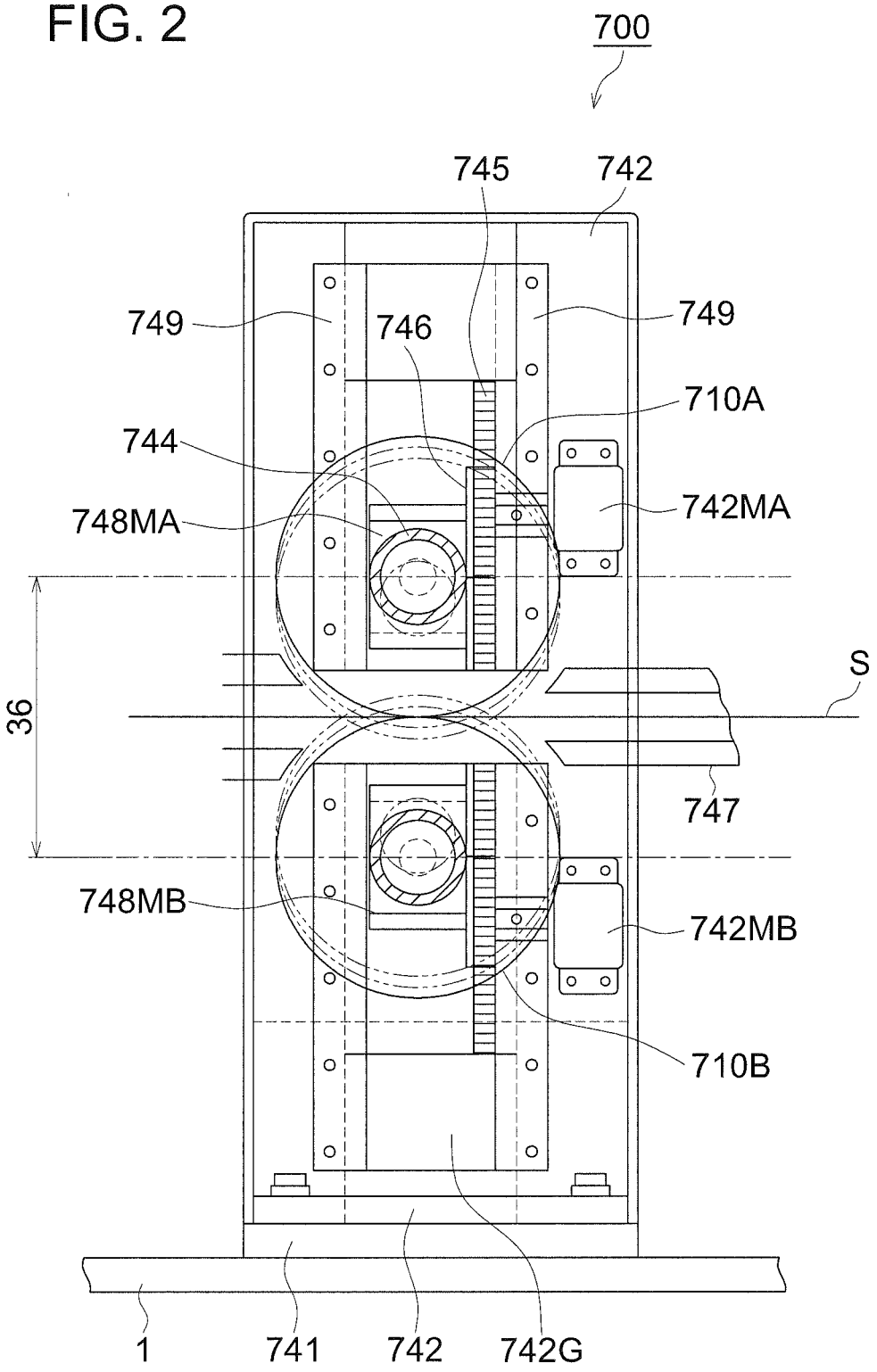
FIG. 2 shows a cross sectional view of the de-curling device, having an initial phase-angle changing section, and a clearance changing section to change the center distance between the first and second de-curling rollers.
Figure 3:
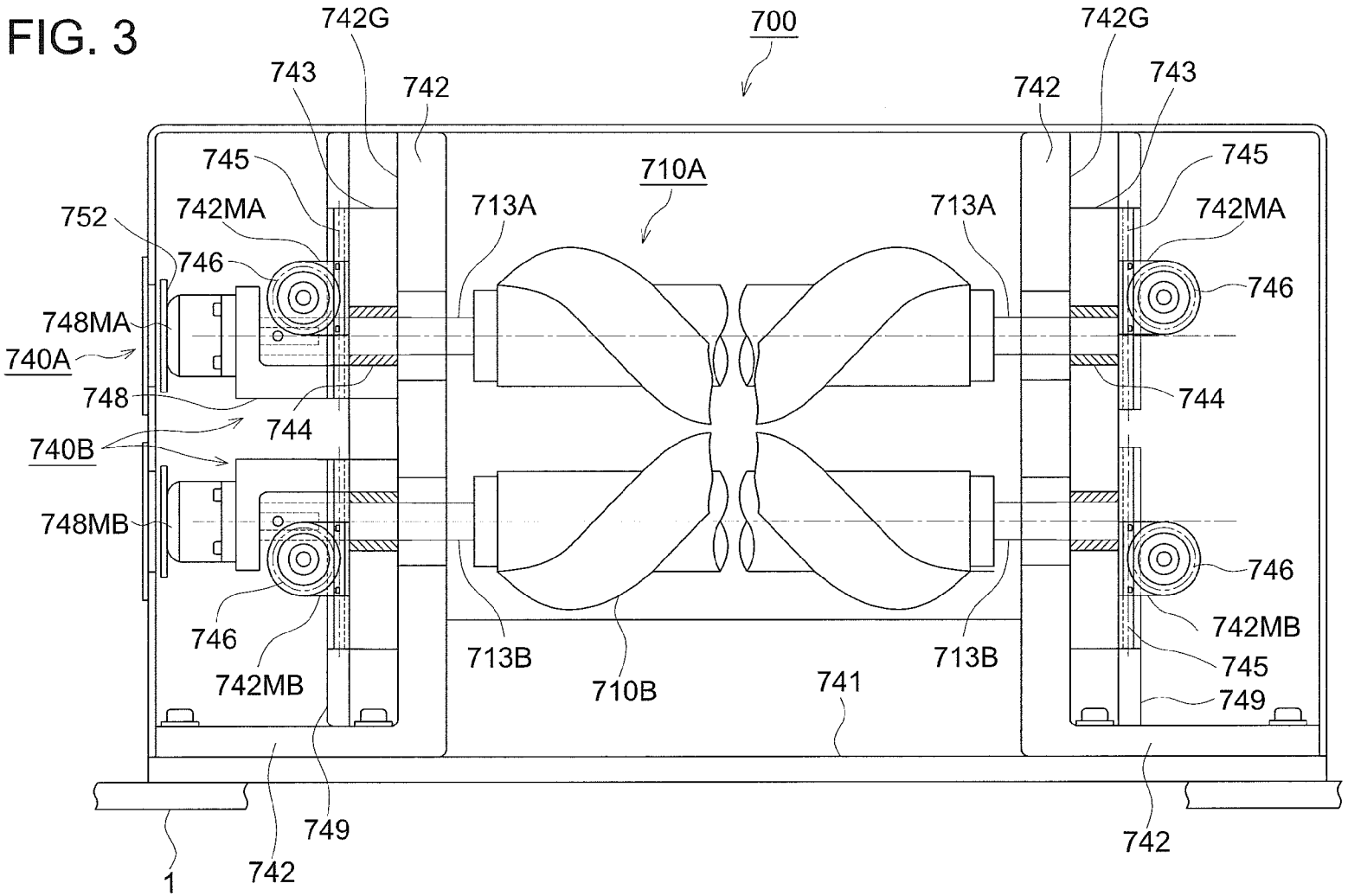
FIG. 3 is a side cross sectional view of FIG. 2.

The structure of de-curling device 700 will now be detailed, while referring to FIG. 2, illustrating a cross-sectional view of its front surface, and FIG. 3, illustrating a cross-sectional view of its side surface. De-curling roller set 710 includes first de-curling roller 710A, having rotating shaft 713A, and second de-curling roller 710B, having rotating shaft 713B. Both ends of rotating shaft 713A are rotatably supported by bearings 744, mounted in bearing holders 743, and both ends of rotating shaft 713B are rotatably supported by bearings 744, mounted in bearing holders 743. Bearing holders 743 slide in guides, structured of guide grooves 742G and guide plates 749, provided on base frames 742. Said base frames 742 are united to base member 741, and are mounted on image forming apparatus 1 through base member 741.

First de-curling roller 710A and second de-curling roller 710B exhibit spiral rollers, wherein the thread diameter, the root diameter, the lead angle, and the spiral pitch of first de-curling roller 710A are equal to those of second de-curling roller 710B. The spirals are formed clockwise and counterclockwise from the predetermined portion of the cylindrical shaft, which forms the root section, to both ends, that is, the spirals are formed to be symmetrical on the cylindrical shaft. Further, the directions of the lead angles of the spirals of first and second de-curling rollers 710A and 710B of de-curling roller set 710 are structured to be opposite to each other. The shapes and functions of first and second de-curling rollers 710A and 710B will be detailed later while referring to FIGS. 5, 6 and 7.

While using de-curling device 700, in which first and second de-curling rollers 710A and 710B are included, the inventors of the present invention confirmed that the various curls as well as the positive or negative curls were effectively flattened. Further, the inventors have added a setting function and a changing function of the initial phase-angle and the center distance between the roller shafts, to regulate the relative positions of first and second de-curling rollers 710A and 7108, and finally the inventors have completed de-curling device 700, which can easily flatten the almost curls, depending upon the curling directions, the curling shapes, and the curling amounts, of the positive and negative curls of the recording sheets. Further details of de-curling device 700 will continued below.

Initial phase-angle changing section 740A is configured to set and change the initial phase-angle difference between first and second de-curling rollers 710A and 710B, and center distance changing section 740B is configured to change the center distance between first and second de-curling rollers 710A and 710B.

Center distance changing sections 740B are structured of rack gears 745, mounted in bearing holders 743, motors 742MA and 743MB, mounted on base frames 742, and pinion gears 746, driven by said motors, engaging with rack gears 745. Since bearing holders 743 of both shafts are vertically driven at a predetermined length to set or change the center distance between the shafts, a standard surface for the sheet conveying through path 747 is not vertically changed.

As shown in FIG. 3, shifting mechanisms, structured of rack gears 745, pinion gears 746, motors 742MA and 742MB, of center distance changing sections 740B, are mounted at both ends of first de-curling roller 710A, and at both ends of second de-curling roller 710B. Accordingly, adjusting movements of the center distance can be easily conducted at both ends.

Figure 4:
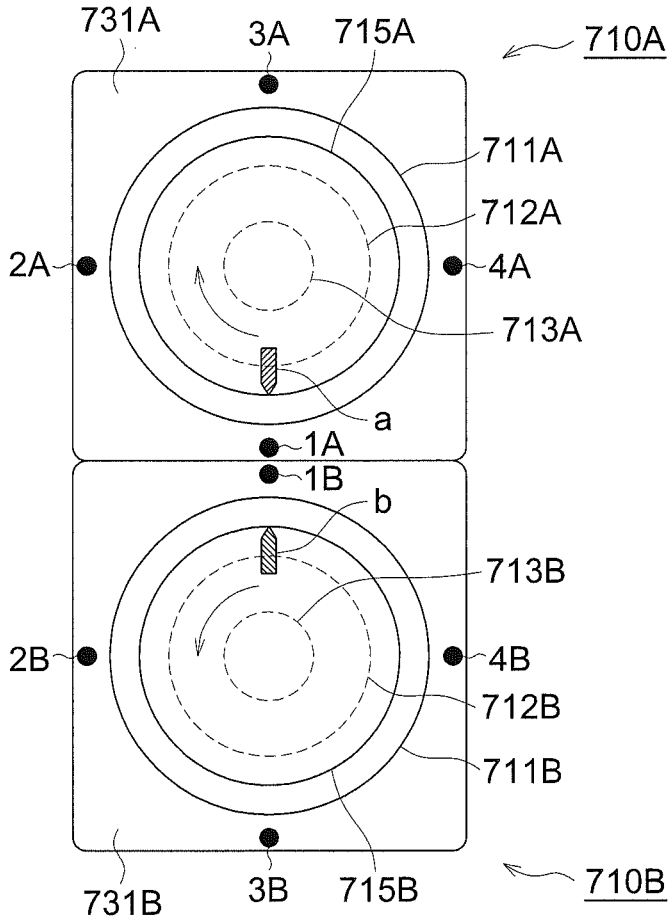
FIG. 4 details the initial phase-angle changing section which defines relative positional relationships of the rotating directions of the first and second de-curling rollers.

The initial phase-angle will now be detailed while referring to FIG. 4. FIG. 4 is a front view of the ends of first and second de-curling rollers 710A and 710B, whereby the initial phase-angle changing section is detailed to define the relative positional relationships of both rollers 710A and 710B. Indication disk 715A is concentrically mounted on the end of first de-curling roller 710A, having thread section 711A, root section 712A, and rotating shaft 713A. Indication disk 715B is concentrically mounted on the end of second de-curling roller 710B, having thread section 711B, root section 712B, and rotating shaft 713B. Under a basic condition shown in FIG. 4, indicator "a" of indication disk 715A meets point 1A of stationary plate 731A, while indicator "b" of indication disk 715B meets point 1B of stationary plate 731B. Stationary plates 731A and 731E are adhered to the housings of motors 748MA and 748MB. When a job is started under this condition, indication disk 715A, having indicator "a", and indication disk 715B, having indicator "b", begin to rotate, as shown by formulas (1) and (2), $$\Phi A = 2\pi t/T + \alpha A \qquad \text{Formula (1)}$$

$$\Phi B = 2\pi t/T + \alpha B \qquad \text{Formula (2)}$$

That is, based on formula (1), indication disk 715A uniformly rotates clockwise, and returns to the basic position by one rotation (indicator "a" comes to meet point 1A), which rotation will be continued, until the job will be stopped. In the same manner, based on formula (2), indication disk 715E uniformly rotates counterclockwise, and returns to the basic position by one rotation (indicator "b" comes to meet point 1B), which rotation will be continued, until the job will be stopped.

In Formulas (1) and (2), "ΦA" and "ΦB" represent total phase-angles, "αA" and "αB" represent initial phase-angles, "t" represents time, and "T" represents cycle. Under the above described basic condition, "αA" and "αB"=0. "αA–αB" represents the difference between the initial phase-angles, which difference shows the relative positions of first and second de-curling rollers 710A and 710B. In the present invention, the adjustment is conducted under "αB=0", so that the difference of the initial phase-angles is shown by "αA".

In order to set the initial phase-angle between both indication disk 715A and 715B to be π radian (=180°), indicator "a" of indication disk 715A is rotated clockwise from point 1A to point 3A, while indication disk 715B is stayed at the initial position, that is, "αB" equals to zero. Further, in order to set the initial phase-angle difference between both indication disk 715A and 7153 to be π/2 radian (=90°), indicator "a" of indication disk 715A is rotated clockwise from point 1A to point 2A, while indication disk 715B is stayed at the initial position, that is, "αB" equals to zero. Still further, in order to set the initial phase-angle difference between both indication disk 715A and 715B to be 3/2 π radian (=270°), indicator "a" of indication disk 715A is rotated clockwise from point 1A to point 4A, while indication disk 715B is stayed at the initial position, that is, "αB" equals to zero. By the above methods, the relative positional relationships between first and second de-curling rollers 710A and 7108 can be determined. That is, after the initial phase-angle is set, and the job is started, de-curling rollers set 710 can rotate, while keeping the initial phase-angle difference.

Initial phase-angle changing section 740A, to set and change the initial phase-angle, will be detailed while referring to FIGS. 2 and 3.

Changing operation of the initial phase-angle difference between first and second de-curling rollers 710A and 710B should be conducted, after the center distance between said rollers is sufficiently increased, so that neither roller comes into contact with each other. As detailed before, motor 748MA is connected to rotation shaft 713A of first de-curling roller 710A, and motor 748MB is connected to rotation shaft 713B of second de-curling roller 710B. One of motors 748MA and 748MB, that is, motor 748MA, for example, is activated to rotate at a predetermined angle, so that the initial phase-angle difference between de-curling rollers 710A and 710B can be changed to a predetermined angle. In addition, motors 748MA and 748MB are respectively mounted on brackets 748, which are mounted on bearing holders 743.

In order to change the initial phase-angle, a pulse motor, serving as motor 748MA or motor 748B, may be used, which motor rotates based on the number of pulses being added, so that the initial phase-angle difference between first and second de-curling rollers 710A and 710B can be set to the predetermined value, or said angle difference can be changed to desired values. Further, encoder 752 is used, which is connected to the shaft of the above motor. On disk 752A of encoder 752, a small hole is provided at a point, corresponding to a predetermined initial phase-angle. When a beam sensor detects the small hole, motor 748MA is controlled to stop, whereby the predetermined initial phase-angle is obtained corresponding to second de-curling roller 710B.

After the initial phase-angles are determined as above, at least during the operation of the de-curling device, the initial phase-angles are kept without being changed for that operation. Said operation is easily attained by an electronic circuit, which supplies the same number of the pulses to both pulse motors 748MA and 748MB.

By the above methods, the initial phase-angle, and the center distance are correctively and desirably changed, whereby during the operation of de-curling device 700, the initial phase-angle is not varied, and the de-curling operation can be effectively continued.

In the above explanations, after the initial phase-angle of second de-curling roller 710B is set to 0, the initial phase-angle of first de-curling roller 710A is obtained. Instead, after the initial phase-angle of first de-curling roller 710A is set to 0, the initial phase-angle of second de-curling roller 710B is also obtained. Both methods can be used.

Figure 5A:
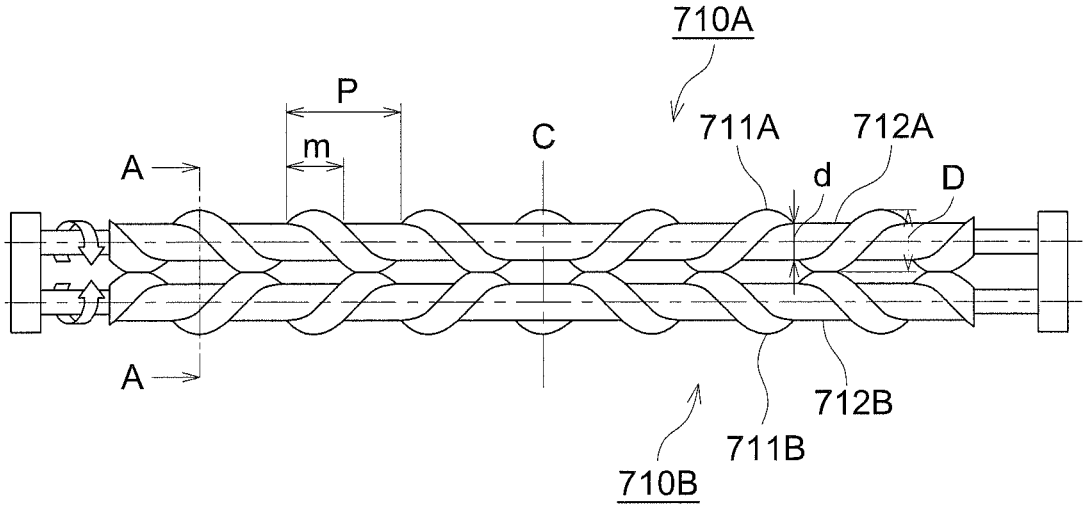
FIG. 5*a* is a side view of the first and second de-curling rollers, wherein the initial phase-angle of the spirals of the first and second de-curling rollers is set to be 0°.
Figure 5B:
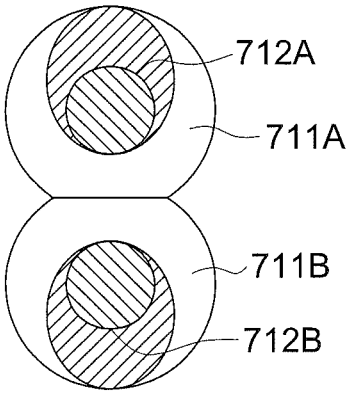
FIG. 5*b* is the cross sectional view taken along line A-A of FIG. 5*a;*
Figure 6A:
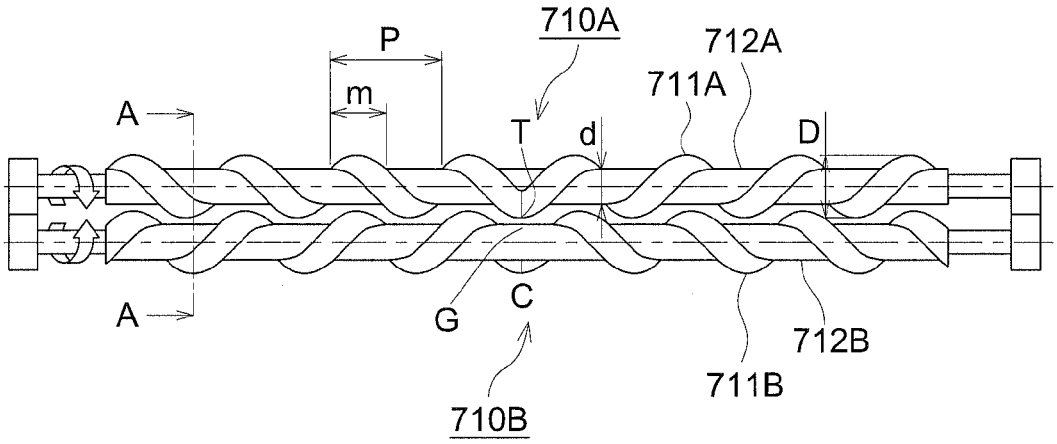
FIG. 6*a* is a side view of the first and second de-curling rollers, wherein the initial phase-angle of the spirals of the first and second de-curling rollers is set to be 180°.
Figure 6B:
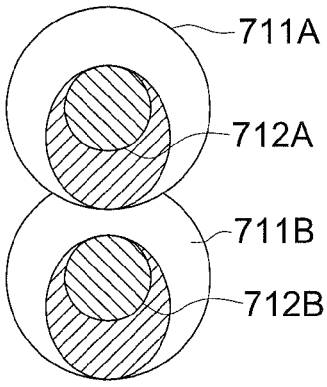
FIG. 6*b* is the cross sectional view taken along line A-A of FIG. 6*a;*
Figure 7A:
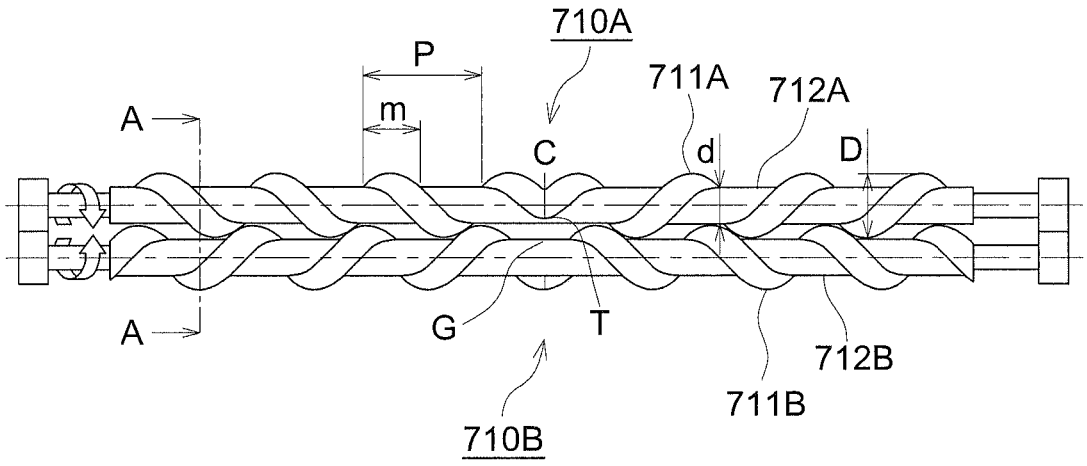
FIG. 7*a* is a side view of the first and second de-curling rollers, wherein the initial phase-angle of the spirals of the first and second de-curling rollers is set to an intermediate angle between 0° and 180°.
Figure 7B:
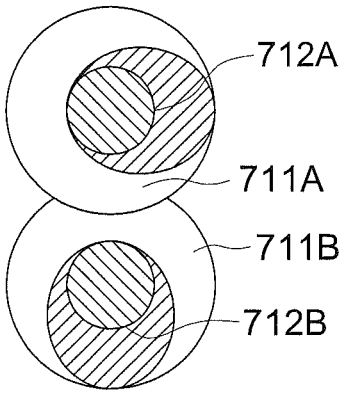
FIG. 7*b* is the cross sectional view taken along line A-A of FIG. 7*a*.

The function of de-curling device 700 of the present invention will now be detailed while referring to FIG. 5*a* showing a side view, and FIG. 5*b* showing an A-A sectional view of FIG. 5*a*, wherein the initial phase-angle difference between first and second de-curling rollers 710A and 710B of de-curling device 700 is set to zero as the standard. Further, the function of de-curling device 700 will also be detailed while referring to FIG. 6*a* showing a side view, and FIG. 6*b* showing an A-A sectional view of FIG. 6*a*, wherein the initial phase-angle difference between first and second de-curling rollers 710A and 710B of de-curling device 700 is set to 180°. Still further, the function of de-curling device will be detailed while referring to FIG. 7*a* showing a side view, and FIG. 7*b* showing an A-A sectional view of FIG. 7*a*, wherein the initial phase-angle difference between first and second de-curling rollers 710A and 710E of de-curling device 700 is set to 90°, which is an intermediate value between 0° and 180°.

In FIGS. 5*a* and 5*b*, first de-curling roller 710A and second de-curling roller 710B, represent rollers having spiral sections, wherein diameter "D" of thread sections 711A and 7113 is 38 mm, diameter "d" of root sections 712A and 712B is 18 mm, pitch "P" of spiral is 62 mm, length "m" of thread sections 711A and 711B in the axial directions is 24 mm, and A-A cross sectional views of thread sections 711A and 711B represent half circles. However, the invention is not limited to the above shapes and sizes. First de-curling roller 710A has cylindrical shaft 712A to form the root section. A spiral is formed clockwise at a uniform pitch from predetermined point "C" on the center of shaft 712A to one end of said shaft 712A, and another spiral is formed counterclockwise at a uniform pitch from predetermined point "C" on the center of shaft 712A to the end of said shaft 712A, wherein the pitch of the clockwise spiral is equal to the pitch of the counterclockwise spiral, and the clockwise spiral and the counterclockwise spiral have line symmetry with respect to a vertical line passing on point "C" on shaft 712A. Further, a spiral is formed clockwise at a uniform pitch from predetermined point "C" on the center of shaft 712B to one end of said shaft 712B, and another spiral is formed counterclockwise at a uniform pitch from predetermined point "C" on the center of shaft 712B to the end of said shaft 712B, wherein the pitch of the clockwise spiral is equal to the pitch of the counterclockwise spiral, and the clockwise spiral and the counterclockwise spiral have line symmetry with respect to a vertical line passing on point "C" on shaft 712B. Accordingly, the lead angle of the spiral of first de-curling roller 710A is determined to be in opposite directions to the lead angle of the spiral of second de-curling roller 710B, though the values of both lead angles are equal to each other.

Figure 9A:
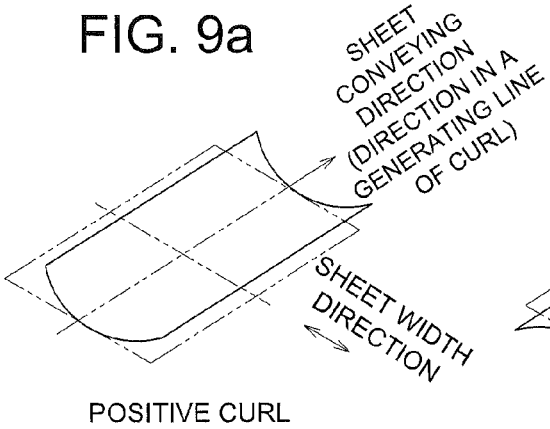
FIG. 9*a* shows another positive curl, that is, a sheet is concave when viewed from above, and its generating line is parallel to the sheet feeding direction.
Figure 9B:
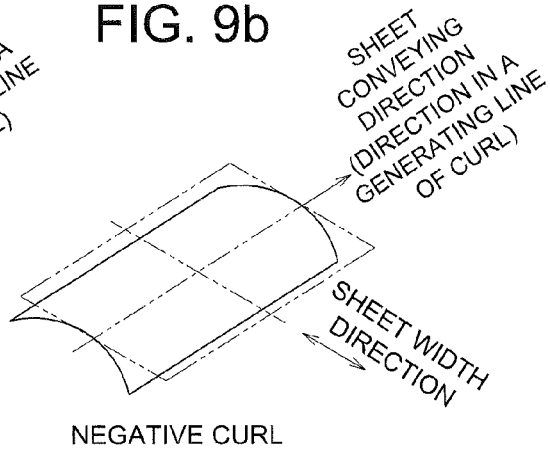
FIG. 9*b* shows another negative curl, that is, a sheet is convex when viewed from above, and its generating line is parallel to the sheet feeding direction.
Figure 9C:
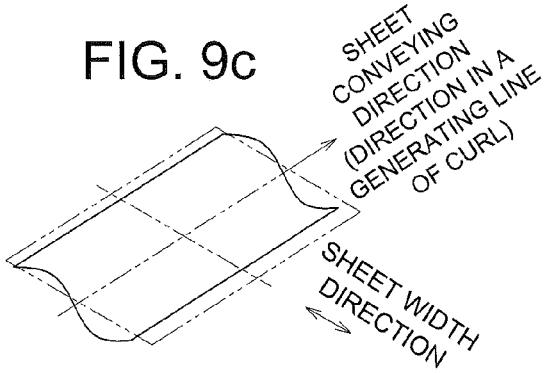
FIG. 9*c* shows a wave-curled sheet, and its generating line is parallel to the sheet feeding direction.
Figure 10A:
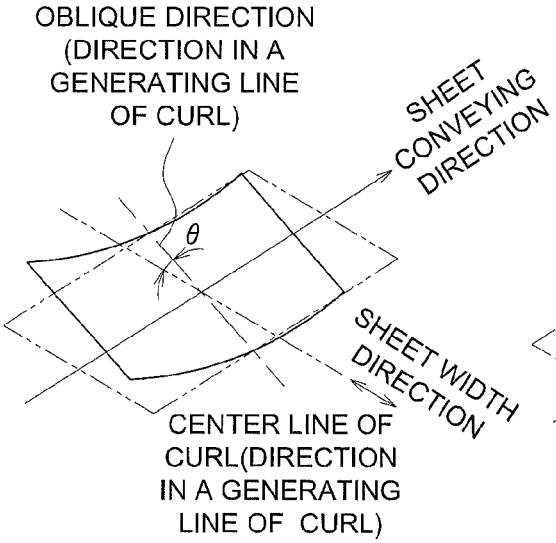
FIG. 10*a* shows yet another positive curl, that is, a sheet is concave when viewed from above, and its generating line is slant to the sheet feeding direction.
Figure 10B:
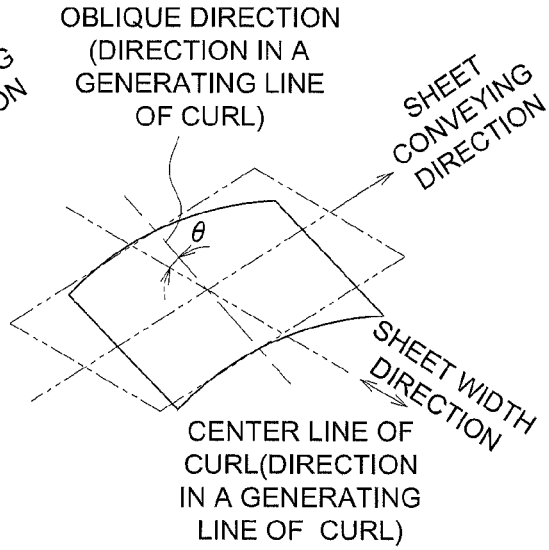
FIG. 10*b* shows yet another negative curl, that is, a sheet is convex when viewed from above, and its generating line is slant to the sheet feeding direction.

In FIGS. 5*a* and 5*b*, showing the initial phase-angle difference of "0°", thread section 711A of first de-curling roller 710A and thread section 711B of second de-curling roller 710B are formed of elastic members, wherein both elastic members are configured to sandwich, and come into pressure-contact with, the recording sheet. Accordingly, both de-curling rollers 710A and 7103 press the recording sheets at plural contacting points of thread sections 711A and 711B, whereby when both de-curling rollers 710A and 710B are rotated, the plural contacting points shift from the predetermined point on the center of both 710A and 710B toward both ends of de-curling rollers 710A and 710B. By the shifts of the plural contacting points, the curled recording sheet is effectively flattened. Because, the curved surface, where the generating lines gather together, is pressed and extended in the direction perpendicular to the generating lines, whereby the positive curl and the negative curl, being the parallel curls, shown in FIGS. 9*a* and 9*b*, and the waved curl, shown in FIG. 9*c* are effectively flattened.

Figure 8A:
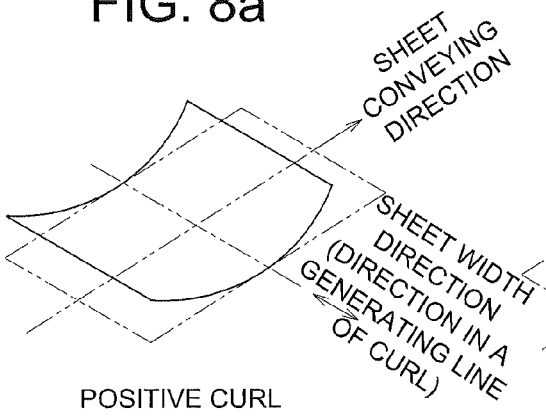
FIG. 8*a* shows a positive curl, that is, a sheet is concave when viewed from above, and its generating line is perpendicular to the sheet feeding direction.
Figure 8B:
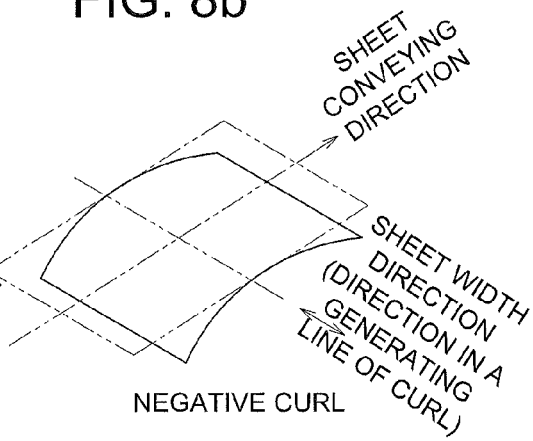

In FIGS. 6*a* and 6*b*, showing the initial phase-angle difference of 180°, top portion T of thread sections 711A and middle portion G of root section 712B, of the spirals of first and second de-curling rollers 710A and 710B, are configured to face each other. When both de-curling rollers 710A and 710B are rotated, the recording sheet is alternately nipped at even intervals, and pulled by thread sections 711A and 711B. Therefore, the recording sheet is conveyed, while receiving tensions to function from the center of both de-curling rollers 710A and 710B toward both ends, whereby, the positive curl and the negative curl, being the orthogonal curls, shown in FIGS. 8*a* and 8*b*, are effectively flattened. Because, curved surfaces of the front and reverse, where the generating lines gather together, are pressed and evenly extended in the direction of the generating lines, whereby the positive curl and the negative curl may be flattened.

In FIGS. 7*a* and 7*b*, showing the initial phase-angle difference of 90°, being an intermediate angle between 0° and 180°, top portion T of thread section 711A and middle portion G of root section 712B are configured to face each other in a deflected state. Accordingly, both thread section 711A and 711B of de-curling rollers 710A and 710B exhibit uneven interval, and close to each other, whereby the recording sheet is extended toward both its edges (being in the width direction). Further, the positive or negative oblique curl, includes a curling axis, the generating line of which is θ° oblique to the width direction of the recording sheet. When de-curling rollers 710A and 710B are rotated, the oblique curled sheet is nipped alternately at an uneven interval under the deflected state, and thereby the recording sheet is conveyed, while receiving the tension directed toward the width direction. Subsequently, the oblique curl of the recording sheet is changed to be the orthogonal curl, and subsequently, the orthogonal curl is flattened.

Further, when the initial phase-angle is set to be 270°, being an intermediate angle between 180° and 360°, since the angle of the oblique curl is opposite to the case of angle 90°, the curled recording sheet is flattened in the same way as the case of 90°.

Still further, whichever way the curl may be formed, among the orthogonal curl, the parallel curl or the oblique curl, the center distance between first and second de-curling rollers 710A and 710B is adequately determined, based on the curling amounts.

Concerning the quality of material of first and second de-curling rollers 710A and 7108, at least thread sections 711A and 711B should be structured of elastic members, and urethane foam, exhibiting 7 on the ASCA C Scale, or silicon foam, exhibiting 13 on the ASCA C Scale, are more preferably used. Due to the elastic members, areas of the recording sheet, nipped by thread sections 711A and 711B, become larger, whereby frictional force and pulling force against the recording sheet become greater, a flattening effect for the curled sheet becomes stable. For the shaft sections, polyacetal resin is preferably used. However, metallic members can also be used for the shaft sections. Further, elastic thread sections and elastic root sections can be united on metallic shafts.

While de-curling device 700 is not activated, the initial phase-angle difference between first and second de-curling rollers 710A and 710B can be changed, and the center distance between the above rollers 710A and 710B can be increased, whereby the durability of de-curling roller set 710, and first and second de-curling rollers 710A and 710B, structuring the same set can be increased.

Further, while de-curling device 700 is not activated, without changing the center distance between first and second de-curling rollers 710A and 710B, the initial phase-angle can be changed from a condition on which thread sections 711A and 711B face to each other, to other condition on which thread sections 711A face root sections 712B. Due to this changing action, both de-curling rollers are prevented from pressing to each other, whereby the durability of the rollers can easily be increased.

As detailed above, according to the present invention, on whichever surfaces the recording sheet is curled, and however great the curl may be, and however great the recording sheet variety, since the spiral sections apply the friction force and the pulling force on the recording sheet, the curled sheet is desirably flattened.

De-curling device 700 of the present invention can flatten various curled sheets, exhibiting various directions of the curl, various shapes of curls, various amounts of curls, various types of recording sheets, various sizes of recording sheets, by the method as detailed above. In order to support the above cases, the experimental data will now be detailed.

De-curling device 700, including first and second de-curling rollers 710A and 710B, detailed in FIGS. 5*a* and 5*b*, FIGS. 6*a* and 6*b*, and FIGS. 7*a* and 7*b*, is used in the experiments, in which the initial phase-angle and the center distance between the rollers are changed, and various types of recording sheets are flattened, which will be detailed below.

[Preparation of the Recording Sheets as Samples]

Item (1) Types of the recording sheets, depending upon sheet quality: four qualities, being quality A, quality B, quality C and quality D;

Item (2) Sizes of the recording sheets: five sizes, being size A4, size A3, size A4R, size B4, and size B5;

Item (3) Shapes of the curl: five shapes, being no curl, orthogonal curl, oblique curl, parallel curl, and waved curl;

Item (4) Curling amount: five groups, being 3-8 mm, 9-14 mm, 15-20 mm, and 0-2 mm (exhibiting no curl);

As shown in Table 1, while items (1) to (4) are combined, the recording sheets as the samples are prepared for condition 1-1, condition 2-1, condition 2-2, condition 2-3, condition 3-1, condition 3-2, condition 3-3, condition 4-1, condition 4-2, condition 4-3, condition 5-1, condition 5-2, condition 5-3, wherein each condition includes 20 positively curled sheets and 20 negatively curled sheets.

[Experimental Results]

Each sample sheet under the above conditions is introduced into de-curling device 700 of the present invention, combined to image forming apparatus 1.

The quality and the size of de-curling rollers 710A and 710B to receive the curled recording sheets have been detailed above.

When the initial phase-angle difference between first and second de-curling rollers 710A and 710E is 0°, and when the center distance between first and second de-curling rollers 710A and 710B is 36 mm, sample recording sheets under condition 1-1, (that is, recording sheets having no curl) are introduced into de-curling device 700, and are normally ejected from said device 700, whereby no adverse curl is generated on said recording sheets.

In this experiment, it is determined that the flattened recording sheet exhibits a maximum curl height of 0-2 mm, placed on the desk.

When the initial phase-angle difference between first and second de-curling rollers 710A and 710B is 180°, and when the center distance between said rollers 710A and 710B is 33 mm, the sample sheets of condition 2-1 are introduced into de-curling device 700, and are normally ejected from said device 700.

When the center distance between said de-curling rollers is 30 mm, the sample sheets of condition 2-2 are introduced into de-curling device 700, and are normally ejected from said device 700.

When the center distance between said de-curling rollers is 27 mm, the sample sheets of condition 2-3 are introduced into de-curling device 700, and are normally ejected from said device 700.

When the initial phase-angle difference between first and second de-curling rollers 710A and 710B is 90°, and when the center distance between first and second de-curling rollers 710A and 710B is 33 mm, sample recording sheets under condition 3-1 are introduced into de-curling device 700, and are flattened by said device 700, and normally ejected.

When the center distance between the said rollers is 30 mm, sample recording sheets under condition 3-2 are introduced into de-curling device 700, and are flattened by said device 700, and normally ejected.

When the center distance between said de-curling rollers is 27 mm, sample recording sheets under condition 3-3 are introduced into de-curling device 700, and are flattened by said device 700, and normally ejected.

When the initial phase-angle difference between first and second de-curling rollers 710A and 7103 is 0°, and when the center distance between first and second de-curling rollers 710A and 710B is 33 mm, sample recording sheets under condition 4-1 are introduced into de-curling device 700, and are flattened by said device 700, and normally ejected.

When the center distance between said de-curling rollers is 30 mm, sample recording sheets under condition 4-2 are introduced into de-curling device 700, and are flattened by said device 700, and normally ejected.

When the center distance between said de-curling rollers is 27 mm, sample recording sheets under condition 4-3 are introduced into de-curling device 700, and are flattened by said device 700, and normally ejected.

When the center distance between said de-curling rollers is 33 mm, sample recording sheets under condition 5-1 are introduced into de-curling device 700, and are flattened by said device 700, and normally ejected.

When the center distance between said de-curling rollers is 30 mm, sample recording sheets under condition 5-2 are introduced into de-curling device 700, and are flattened by said device 700, and normally ejected.

When the clearance between said de-curling rollers is 27 mm, sample recording sheets under condition 5-3 are introduced into de-curling device 700, and are flattened by said device 700, and normally ejected.

The above experimental results are shown on the right half of Table 1, while various conditions are shown on the left half of Table 1.

TABLE 1

| | Formation of Sample Sheets Exhibiting Various Curls | | | | Actions and Results | | | | |
|---|---|---|---|---|---|---|---|---|---|
| | Sheet Introducing Conditions | | | | Initial Phase-angle, and Facing Condition of Spirals of First and Second De-curling Rollers | | | Center Distance between First and Second De-curling Rollers (mm) | |
| | Types of Sheets | Sizes of Sheet | Shapes of Curl | Amounts of Curl (mm) | Initial Phase-angle (Degree) | First De-curling Roller | Second De-curling Roller | | Corrected Results (mm) |
| Condition 1-1 | Type A | A4 | No Curl | 0-2 | 0 | Top of Thread Section | Top of Thread Section | 36 | 0-1 |
| Condition 2-1 | Type B | A3 | Orthogonal Curl | 3-8 | 180 | Top of Thread Section | Center of Root Section | 33 | 0-2 |
| Condition 2-2 | Type B | A3 | Orthogonal Curl | 9-14 | 180 | Top of Thread Section | Center of Root Section | 30 | 0-2 |
| Condition 2-3 | Type B | A3 | Orthogonal Curl | 15-20 | 180 | Top of Thread Section | Center of Root Section | 27 | 0-2 |
| Condition 3-1 | Type C | A4R | Oblique Curl | 3-8 | 90 | Top of Thread Section | *1 | 33 | 0-2 |
| Condition 3-2 | Type C | A4R | Oblique Curl | 9-14 | 90 | Top of Thread Section | *1 | 30 | 0-2 |
| Condition 3-3 | Type C | A4R | Oblique Curl | 15-20 | 90 | Top of Thread Section | *1 | 27 | 0-2 |
| Condition 4-1 | Type D | B4 | Parallel Curl | 3-8 | 0 | Top of Thread Section | Top of Thread Section | 33 | 0-1 |
| Condition 4-2 | Type D | B4 | Parallel Curl | 9-14 | 0 | Top of Thread Section | Top of Thread Section | 30 | 0-2 |
| Condition 4-3 | Type D | B4 | Parallel Curl | 15-20 | 0 | Top of Thread Section | Top of Thread Section | 27 | 0-2 |
| Condition 5-1 | Type E | B5 | Waved Curl | 3-8 | 0 | Top of Thread Section | Top of Thread Section | 33 | 0-2 |
| Condition 5-2 | Type E | B5 | Waved Curl | 9-14 | 0 | Top of Thread Section | Top of Thread Section | 30 | 0-2 |
| Condition 5-3 | Type E | B5 | Waved Curl | 15-20 | 0 | Top of Thread Section | Top of Thread Section | 27 | 0-2 |

*1: Portions other than Center of Root Section

By the above experimental results, independent of the positive or negative curl, the shape of curl, the curling amount, the types of recording sheets, and the sizes of recording sheets, the inventors understand that various kinds of curled sheets can be flattened by de-curling device 700.

When de-curling device 700 is to be activated, the relative positional relationships between first and second de-curling rollers 710A and 710B, being suitable for flattening recording sheets, is set at the initial phase-angle by initial phase-angle changing section 740A, based on information concerning the curled sheet, which information is inputted when the job is started. After that, the center distance between the first and second de-curling rollers 710A and 710B is inputted through center distance changing section 740B.

Figure 11:
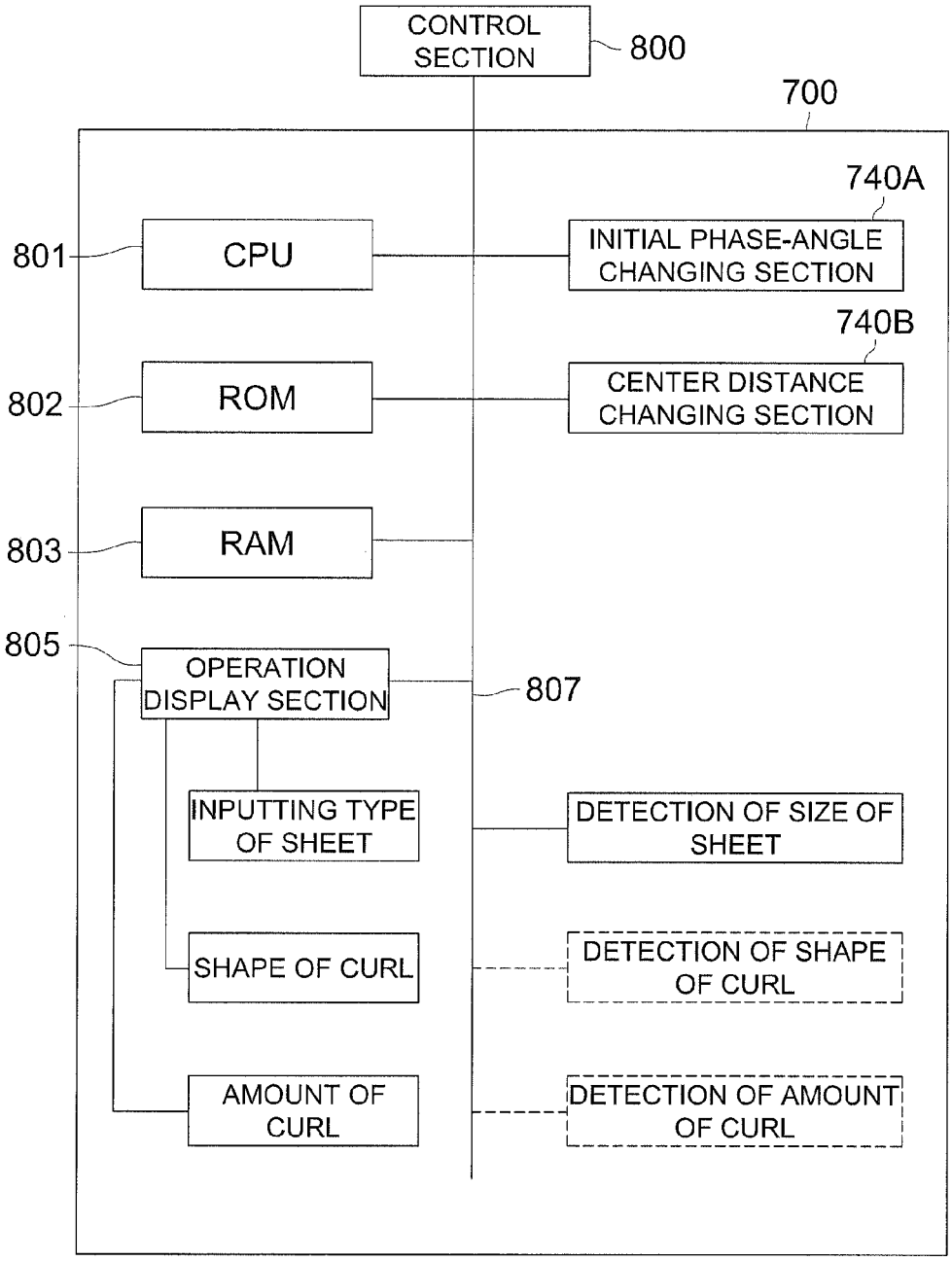
FIG. 11 shows a block diagram of a control system of the de-curling device of the present invention.

The drive control of de-curling device 700 is conducted by control device 800. The drive control will be detailed while referring to FIG. 11.

CPU (Central Processing Unit) 801 is electrically connected to ROM (Read Only Memory) 802, RAM (Random Access Memory) 803, and operation display section 805, through system bus 807. CPU 801 reads out the data table shown in Table 1, among various programs stored in ROM 802, and expands it to RAM 803. Subsequently, various items such as, a detected value concerning the size of sheet, sheet weight, and sheet type to be inputted into operation display section 805, the shape of curl, and the curling amount, are compared with the data table, expanded in RAM 803. Otherwise, the shape of curl and the curling amount can be detected by a curl shape detector or curling amount detector, each detector is mounted upstream of de-curling device 700, shown by dashed lines in FIG. 11, and said detected shape and amount are compared to the data table. After that, the initial phase-angle of first de-curling roller 710A, being equal to the data table, is selected to be set by initial phase-angle changing section 740A, and the center distance between first and second de-curling rollers 710A and 7103 is also selected to be equal to a value in Table 1. That is, various curls are effectively flattened, based on the selected initial phase-angle and the center distance between the rollers.

CPU 801 conducts various processes, using the programs in RAM 803, and stores processed results in RAM 803, and displays them on operation display section 805. Further CPU 801 stores the processed results, stored in RAM 803, in predetermined sections. In the present embodiment, CPU 801 works with ROM 802 and RAM 803, so that a main section of control device 800 is established.

The data shown in Table 1 is an example of a model to flatten the curled sheet, which satisfies the sheet conveying conditions. Further, concerning the sheet conveying condition, the data of the initial phase-angle difference and the data of the center distance are the optimum data obtained by the experiments, to be used in de-curling device 700. However, the sheet conveying conditions are not limited to the data shown in Table 1. That is, the total number of copied sheets in a day, and environmental conditions (being an installation area for the device, the temperature and humidity in the device) can be grouped to realize the most effective de-curling operation. Further, data of the initial phase-angles and data of the center distance between the first and second de-curling rollers 710A and 710B of de-curling device 700, which satisfies the sheet conveying conditions, can be more precisely arranged by the same means as the above model. These data can be found by experiments, in the same way as the data of Table 1 was formed.

Such found data can be previously inputted in ROM 802 of control device 800 of de-curling device 700, and when a sheet conveying condition, corresponding to data other than Table 1, is inputted, optimum initial phase-angle and center distance can be displayed. Further, based on the displayed information, de-curling device 700 can be more precisely adjusted, so that various curled sheets can be flattened in the same way as the case of Table 1. Still further, when a sheet conveying condition is inputted, the initial phase-angle and the center distance, to be used in de-curling device 700, can be automatically changed so said device can easily perform the desired operation.

Concerning the effects of the present invention, based on the directions of curl (being the positive curl or the negative curl), the shape of curl (being parallel, orthogonal, or oblique, to the sheet conveyance direction), and the curling amount, most of various types of curls can be flattened. Due to this, when the printed sheets are ejected onto the tray, said sheets can be orderly stacked on the tray, so that the user can handle the stacked sheets with no difficulty. Further, while the preferred embodiments of the present invention have been described using specific terms, such description is for illustrative purpose only, and it is to be understood that changes and variations may be made without departing from the spirit and scope of the appended claims.

What is claimed is:

1. A sheet de-curling device, comprising:

a first de-curling roller, structured of a round axial shaft and a long bar-shaped member, wherein the long bar-shaped member is spiraled on the round axial shaft clockwise from a predetermined portion of a center of the round axial shaft toward a left end of the round axial shaft, and counterclockwise from the predetermined portion of the center of the round axial shaft toward a right end of the round axial shaft with the same spiraling pitch;

a second de-curling roller, having the same size as the first de-curling roller, to be paired with the first de-curling roller, structured of a round axial shaft and a long bar-shaped member, wherein the long bar-shaped member is spiraled on the round axial shaft in opposite spiraling directions against the first de-curling roller;

an initial phase-angle changing section which is configured to change an initial phase-angle difference between the first de-curling roller and the second de-curling roller, a control section which is configured to control the initial phase-angle changing section, based on a sheet size, a sheet weight, a sheet type, a sheet curling shape, and a sheet curling amount, to change phase-angles of the first de-curling roller and the second de-curling roller in such conditions that:

(i) a top of a thread section of a spiral of the first de-curling roller faces a top of a thread section of the second de-curling roller;

(ii) the top of the thread section of the spiral of the first de-curling roller faces a center of a root section of the second de-curling roller, and (iii) the top of the thread section of the spiral of the first de-curling roller faces a portion other than the center of the root section of the second de-curling roller; and a driving mechanism which is configured to rotate the paired first and second de-curling rollers in such a way that, when a sheet is introduced to be nipped between the paired first and second de-curling rollers, and when the paired first and second de-curling rollers are rotated, plural contacting points, on which the sheet comes into contact with the long bar-shaped members of the first and second de-curling rollers, are configured to shift in a direction from the center to both edges of the sheet.

2. The sheet de-curling device of claim 1, further comprising:

a center distance changing section which is configured to change a center distance between the first de-curling roller and the second de-curling roller.

3. The sheet de-curling device of claim 2, wherein when a curling amount of the recording sheet is minor, the center distance between the first de-curling roller and the second de-curling roller is increased, and when the curling amount of the recording sheet is major, the center distance between the first de-curling roller and the second de-curling roller is reduced.

4. The sheet de-curling device of claim 1, wherein at least one of the long bar-shaped members of the first de-curling roller and the second de-curling roller is formed of an elastic member.

5. An image forming apparatus, comprising a sheet de-curling device comprising:

a first de-curling roller, structured of a round axial shaft and a long bar-shaped member, wherein the long bar-shaped member is spiraled on the round axial shaft clockwise from a predetermined portion of a center of the round axial shaft toward a left end of the round axial shaft and counterclockwise from the predetermined portion of the center of the round axial shaft toward a right end of the round axial shaft with the same spiraling pitch;

a second de-curling roller, having the same size as the first de-curling roller, to be paired with the first de-curling roller, structured of a round axial shaft and a long bar-shaped member, wherein the long bar-shaped member is spiraled on the round axial shaft in opposite spiraling directions against the first de-curling roller;

an initial phase-angle changing section which is configured to change an initial phase-angle difference between the first de-curling roller and the second de-curling roller, a control section which is configured to control the initial phase-angle changing section, based on a sheet size, a sheet weight, a sheet type, a sheet curling shape, and a sheet curling amount, to change phase-angles of the first de-curling roller and the second de-curling roller in such conditions that:

(i) a top of a thread section of a spiral of the first de-curling roller face a top of a thread section of the second de-curling roller;

(ii) the top of the thread section of the spiral of the first de-curling roller faces a center of a root section of the second de-curling roller;

(iii) the top of the thread section of the spiral of the first de-curling roller faces a portion other than the center of the root section of the second de-curling roller, and a driving mechanism which is configured to rotate the paired first and second de-curling rollers in such a way that, when a sheet is introduced to be nipped between the paired first and second de-curling rollers, and when the paired first and second de-curling rollers are rotated, plural contacting points, on which the sheet comes into contact with the long bar-shaped members of the first and second de-curling rollers, are configured to shift in a direction from a center to both edges of the sheet.

6. The image forming apparatus of claim 5, wherein the sheet de-curling device further comprises a center distance changing section which is configured to change a center distance between the first de-curling roller and the second de-curling roller.

7. The image forming apparatus of claim 5, wherein least one of the long bar-shaped members of the first de-curling roller and the second de-curling roller is formed of an elastic member.

8. The image forming apparatus of claim 5, wherein when a curling amount of the recording sheet is minor, the center distance between the first de-curling roller and the second de-curling roller is increased, and when the curling amount of the recording sheet is major, the center distance between the first de-curling roller and the second de-curling roller is reduced.

* * * * *